US009936543B2

(12) United States Patent
Kang

(10) Patent No.: US 9,936,543 B2
(45) Date of Patent: Apr. 3, 2018

(54) DISPLAY DEVICE

(71) Applicant: SAMSUNG DISPLAY CO., LTD., Yongin, Gyeonggi-Do (KR)

(72) Inventor: Min Young Kang, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 373 days.

(21) Appl. No.: 14/705,351

(22) Filed: May 6, 2015

(65) Prior Publication Data

US 2016/0143094 A1 May 19, 2016

(30) Foreign Application Priority Data

Nov. 14, 2014 (KR) ..... 10-2014-0158975

(51) Int. Cl.
*H05B 33/04* (2006.01)
*H05B 33/12* (2006.01)

(52) U.S. Cl.
CPC ..... *H05B 33/04* (2013.01); *H05B 33/12* (2013.01)

(58) Field of Classification Search
CPC ..... H05B 33/04; H05B 33/12
See application file for complete search history.

(56) References Cited

U.S. PATENT DOCUMENTS 9,547,208 B2 * 1/2017 Grip ..... G02F 1/13452
2010/0289994 A1 * 11/2010 Nonaka ..... G02F 1/133514 349/108

FOREIGN PATENT DOCUMENTS

KR 10-0852414 B1 8/2008
KR 10-2008-0091145 A 10/2008
KR 10-2012-0004119 A 1/2012
KR 10-2012-0011294 A 2/2012

* cited by examiner

*Primary Examiner* — Joseph L Williams
(74) *Attorney, Agent, or Firm* — Lee & Morse, P.C.

(57) ABSTRACT

A display device includes a circular display panel, an encapsulation substrate on the circular display panel, and an optical element interposed between the circular display panel and the encapsulation substrate, the optical element including a light guide member having a ring shape to correspond to a boundary of the circular display panel, the light guide member configuring a boundary of the optical element.

17 Claims, 9 Drawing Sheets

DISPLAY DEVICE

CROSS-REFERENCE TO RELATED APPLICATION

Korean Patent Application No. 10-2014-0158975, filed on Nov. 14, 2014, in the Korean Intellectual Property Office is incorporated by reference herein in its entirety.

BACKGROUND

1. Field

Embodiments relate to a display device.

2. Description of the Related Art

A display device is generally manufactured to have a rectangular form factor. However, it may be desirable for a display device to have a form factor that is other than a general rectangular form factor.

SUMMARY

Embodiments are directed to a display device, including a circular display panel, an encapsulation substrate on the circular display panel, and an optical element interposed between the circular display panel and the encapsulation substrate, the optical element including a light guide member having a ring shape to correspond to a boundary of the circular display panel, the light guide member configuring a boundary of the optical element.

The display device may further include a polarizer interposed between the optical element and the circular display panel.

The display device may include a thin film encapsulation layer interposed between the polarizer and the circular display panel.

The display device may further include a bottom substrate below the circular display panel.

The circular display panel may a plurality of pixels, the plurality of pixels may include a plurality of edge pixels configuring a circular boundary of the circular display panel, and the light guide member may have a ring shape to correspond to the plurality of edge pixels.

The plurality of edge pixels may be arranged along a ring-shaped region configuring the circular boundary of the circular display panel.

The plurality of edge pixels may include at least two edge pixels arranged in a stepped shape.

The light guide member may cover a light emitting surface of the plurality of edge pixels.

The light guide member may be larger than the circular boundary of the circular display panel.

The light guide member may cover a light emitting surface of pixels adjacent to the plurality of edge pixels.

The encapsulation substrate may include a concave part etched to correspond to the shape of the light guide member, and at least a part of the light guide member may be in the concave part.

In the optical element, the light guide member may surround a void.

In the optical element, the light guide member may surround a portion made of a light transmitting material.

The light transmitting material and the encapsulation substrate may be made of the same material.

Embodiments are also directed to a display device, including an active display panel including a plurality of pixels arranged in a regular array, an outermost boundary of the array including at least one stepped area in which the pixels form a staircase arrangement in a plan view, and a visible light-transmitting solid member overlapping the stepped area in the plan view such that visible light emitted from pixels in the stepped area is visible through the solid member, the solid member defining an interior region.

The solid member may contact an upper surface of pixels in the stepped area.

The fluid may be a gas.

The pixels of the active display panel may be individually addressable and may be disposed in rows and columns in the array, ends of rows and columns forming the stepped area.

The pixels may generate light, some of the pixels generating light that is visible through the solid member to a user of the display device and some of the pixels generating light that is visible through the interior region to the user of the display device.

The interior region may be in a vacuum state or filled with a fluid

BRIEF DESCRIPTION OF THE DRAWINGS

Features will become apparent to those of skill in the art by describing in detail example embodiments with reference to the attached drawings in which.

DETAILED DESCRIPTION

Figure 1A:
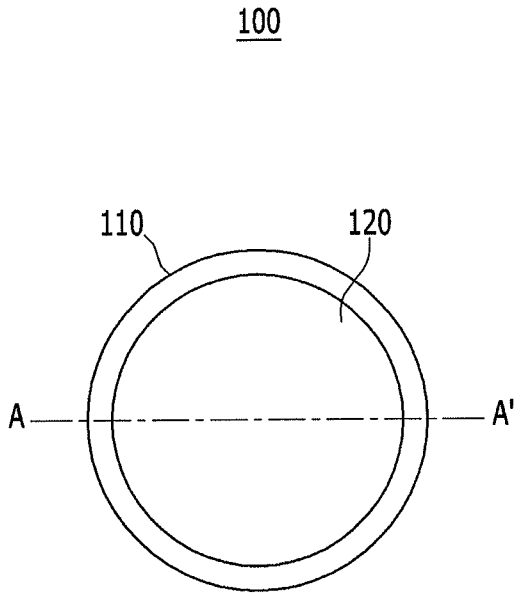
FIGS. 1A and 1B illustrate a configuration of an optical element according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey example implementations to those skilled in the art.

In the drawing figures, the dimensions of layers and regions may be exaggerated for clarity of illustration. Like reference numerals refer to like elements throughout.

Terms or words used in the present specification and claims, which will be described below, should not be interpreted as being limited to typical or dictionary meanings, but should be interpreted as having meanings and concepts which comply with the technical spirit of the disclosed subject matter, based on the principle that an inventor can appropriately define the concept of the term to describe his/her own invention in the best manner. Therefore, configurations illustrated in the embodiments and the drawings described in the present specification are only examples, and thus it is to be understood that various equivalents and modified examples, which may replace the configurations, are possible.

Further, terms such as first, second, and the like, which are used to describe various components, are just used only to distinguish one component from other components, but not used to limit the components.

Figure 1B:
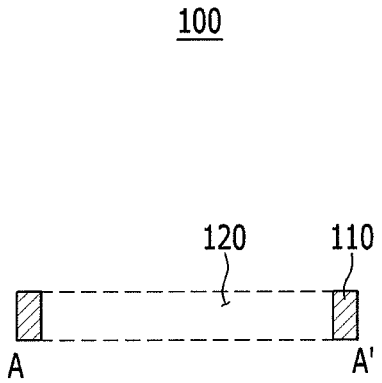

FIGS. 1A and 1B illustrate a configuration of an optical element according to an example embodiment.

FIG. 1A illustrates a front view of an optical element 100 according to an example embodiment, and FIG. 1B is a cross-sectional view of the optical element 100 according to the example embodiment.

Referring to FIG. 1A, the optical element 100 according to the present example embodiment includes a light guide member 110.

The light guide member 110 refers to a member of spreading light which passes through the light guide member 110. A constituent material of the light guide member 100 may use various suitable materials. For example, polymethylmethacrylate (PMMA) and the like may be used.

In an embodiment, the optical element 100 may have a rounded portion. For example, in the present example embodiment, the optical element 100 may be circular.

In the present example embodiment, the light guide member 110 may be formed in a ring shape so as to configure a boundary of the circular optical element 100.

A portion 120 surrounded by the light guide member 110 in the optical element 100 may be a void. Thus, the portion 120 may be an empty space, may be filled with gas such as air, etc.

In another implementation, the portion 120 may be made of a light transmitting material. The light transmitting material may be glass and made of the same material as an encapsulation substrate or window 300.

The portion 120 may be made of a different material from the encapsulation substrate 300. A material such as polyethylene terephthalate (PET) may be used, and an optical film such as an optically clear adhesive (OCA) film may be used.

Figure 2:
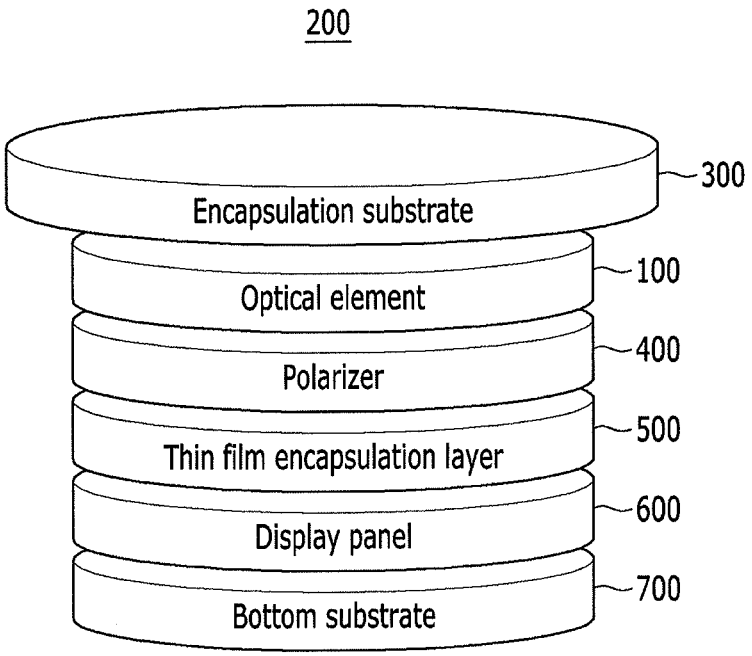
FIG. 2 illustrates a diagram of a configuration of a display device according to an example embodiment.

FIG. 2 illustrates a diagram of a configuration of a display device according to an example embodiment.

Referring to FIG. 2, a display device 200 according to an example embodiment includes the encapsulation substrate 300, the optical element 100, a polarizer 400, a thin film encapsulation layer 500, a display panel 600, and a bottom substrate 700.

The optical element 100 may be interposed between the display panel 600 and the encapsulation substrate 300. The effects of the optical element 100 will be described with reference to the configuration of the display panel 600, the optical element 100, and the encapsulation substrate 300.

A layout of other elements configuring the display device 200 may be as follows.

The polarizer 400 may be interposed between the optical element 100 and the display panel 600 to improve a contrast ratio of the display device 200.

The thin film encapsulation layer 500 may be interposed between the polarizer 400 and the display panel 600 to prevent corrosion of the elements configuring the display panel 600.

The display panel 600 may include pixels that include organic light emitting diodes (OLEDs). The display panel 600 may have a rounded region. In the present example embodiment, the display panel 600 may be a circular display panel 600. The thin film encapsulation layer 500 may prevent the organic layer of the OLEDs from contacting moisture and oxygen in the air.

The bottom substrate 700 may be a backplane for laminating other elements and may be made of, e.g., polyimide, glass, or the like.

Figure 3A:
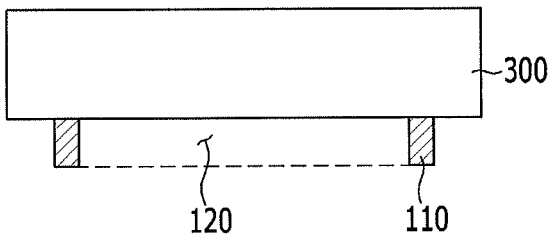
FIGS. 3A and 3B illustrate a configuration of an encapsulation substrate and an optical element.
Figure 3B:
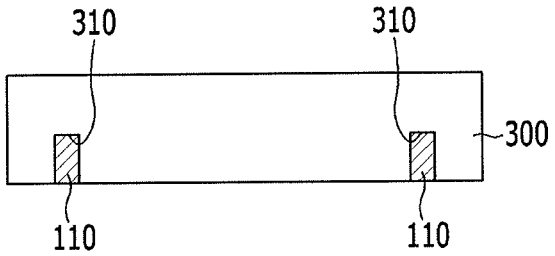

FIGS. 3A and 3B illustrate a configuration of an encapsulation substrate and an optical element.

Referring to FIG. 3A, the optical element 100 is disposed below the encapsulation substrate 300. A user may view the display panel 600 from a position above the encapsulation substrate 300.

As described above, the portion 120 may be made of a light transmitting material. For example, the light transmitting material may be glass and may be the same material as the encapsulation substrate 300.

In another implementation, the portion 120 may be made of a different material from the encapsulation substrate 300. A material such as PET may be used, and an optical film such as an OCA film may be used.

In the embodiment shown in FIG. 3B, the encapsulation substrate 300 includes a recess or concave part 310. In this case, the optical element 100 is configured by only the light guide member 110.

The concave part 310 of the encapsulation substrate 300 may be formed by being etched so that the light guide member 110 may be inserted. Thus, the concave part 310 may be formed to correspond to a shape of the light guide member 110. At least a part of the light guide member 110 may be disposed in the concave part 310.

The example embodiment of FIG. 3B illustrates a configuration in which a height of the light guide member 110 coincides with a height of the concave part 310 such that the optical element 100 is integrated with the encapsulation substrate 300. In another example embodiment, the height of the light guide member 110 may be larger than the height of the concave part 310, and as a result, a part of the light guide member 110 may be disposed in the concave part 310 and the remaining part may protrude from the encapsulation substrate 300. In this case, the portion 120 surrounded by the protruding light guide member 110 may be partially formed, and the portion 120 may have the aforementioned configuration.

As yet another example embodiment, the height of the light guide member 110 may be smaller than the height of the concave part 310. In this case, the part of the concave part 310 not occupied by the light guide member 110 may be used as a connecting configuration with other elements, may be used as a configuration including a new element, etc.

Figure 4:
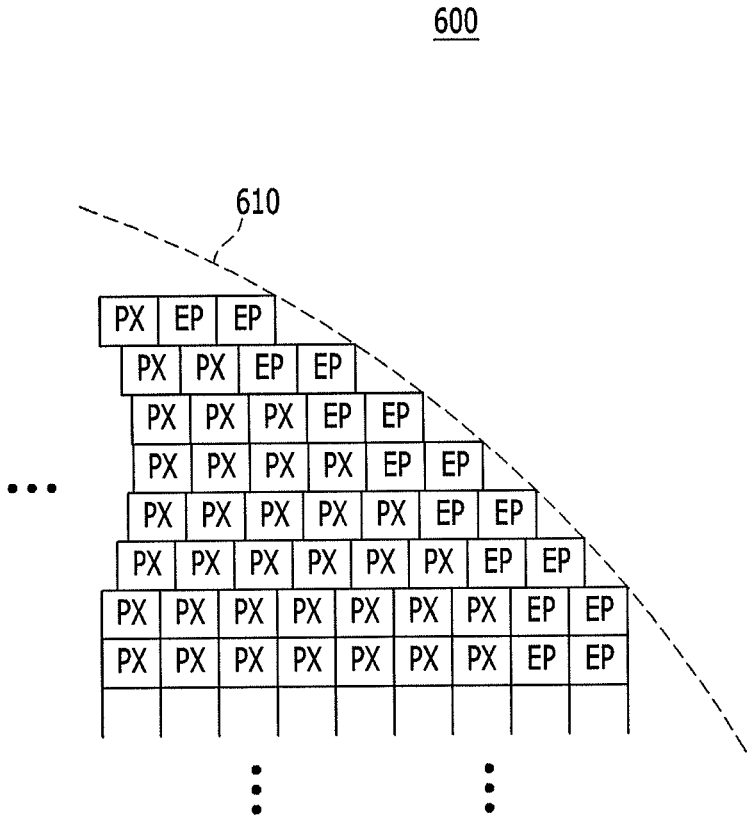
FIG. 4 illustrates a diagram for describing a display panel according to an example embodiment.

FIG. 4 illustrates a diagram for describing a display panel according to an example embodiment.

Referring to FIG. 4, a part of the display panel 600 according to an example embodiment is illustrated.

The display panel 600 may include an arrangement of pixels PX. The display panel 600 may be configured by arranging the pixels PX having one color of R, G, and B by RGB stripe, pentile, and S-stripe methods. The pixels PX may be derived from a quadrangular array in a matrix form. As illustrated in FIG. 4, when the display panel 600 includes a rounded region. e.g., configured to be close to a circle, the boundary of the display panel 600 may have pixels arranged in a stepped shape.

In the present example embodiments, pixels PX configuring a circular boundary 610 of the display panel 600 are called edge pixels EP. The edge pixels EP may be defined differently depending a manufactured design or according to a characteristic of the display panel 600.

The edge pixels EP may be pixels in which some edges, e.g., apexes of the quadrangle and sides of the quadrangle, of the pixels PX border the outside of the display panel 600 having a stepped shape.

Figure 5A:
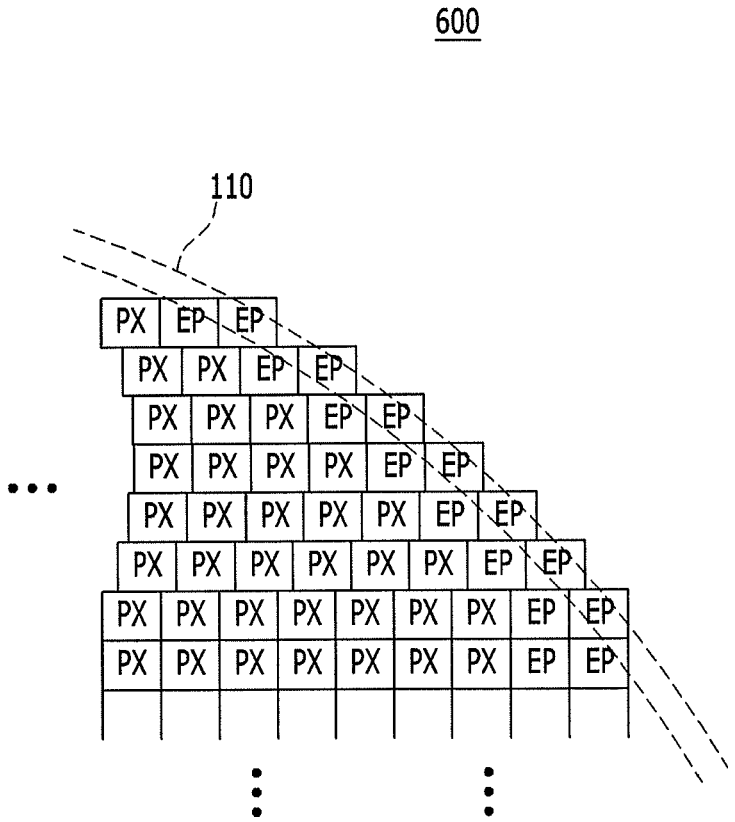
FIGS. 5A-C illustrate configurations of a display panel and a light guide member.
Figure 5B:
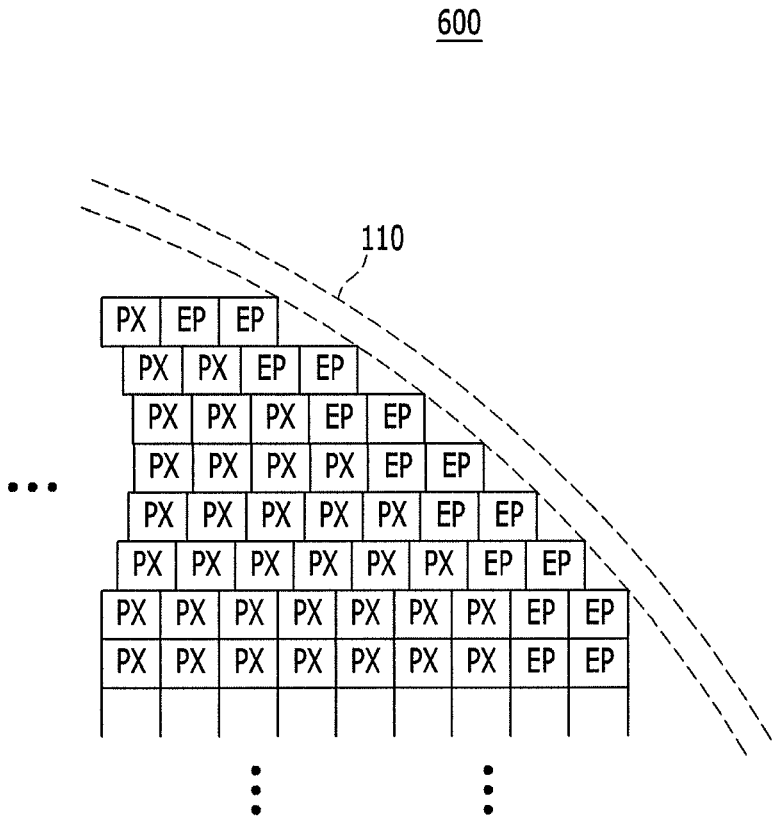
Figure 5C:
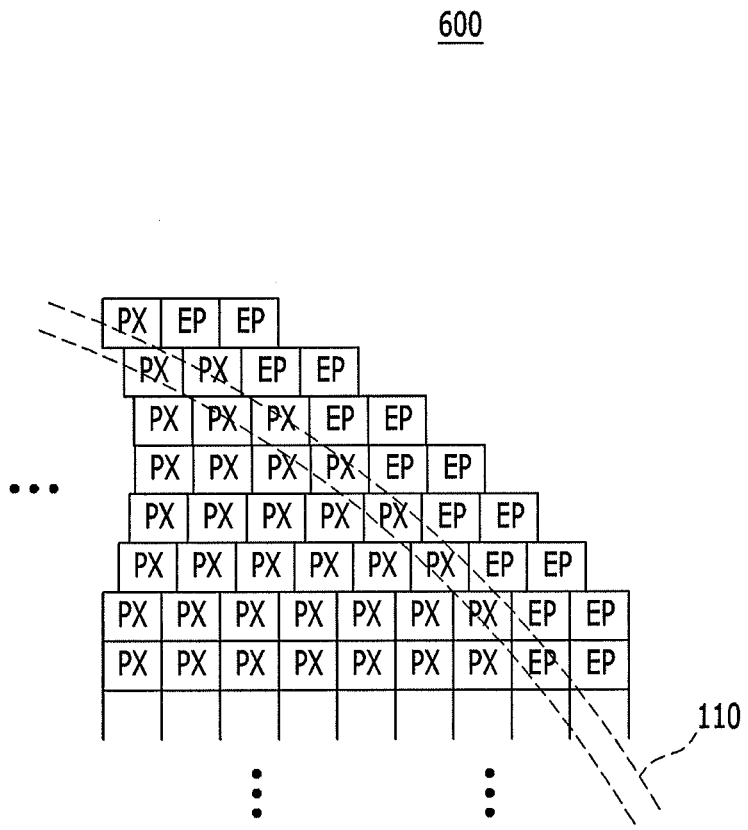

FIGS. 5A-C illustrate configurations of a display panel and a light guide member.

According to the present example embodiment, the light guide member 110 serves as a prism, and thus diffuses light emitted from the plurality of edge pixels EP so as to make a boundary line of the image be faintly displayed.

The stepped edge of the displayed image may be smoothly made and the edge pixels EP may not be covered. Thus, luminance of the displayed image is increased.

Further, there is no need to make a bezel thick to give enhanced aesthetic effects to consumers.

The light guide member 110 may be formed in a ring shape so as to correspond to the plurality of edge pixels EP of the display panel 600.

FIG. 5A illustrates a configuration of the light guide member 110 according to the example embodiment.

In the example embodiment of FIG. 5A, the light guide member 110 is configured to cover a light emitting surface of the plurality of edge pixels EP.

A part of the light guide member 110 may deviate from the display panel 600 area, and a part of the light guide member 110 may cover pixels PX which are not the edge pixels EP.

A detailed dimension may vary according to the characteristic of the display panel 600, the configuration of the light guide member 110, and the like.

FIG. 5B illustrates a configuration of the light guide member 110 according to another example embodiment.

In the example embodiment of FIG. 5B, the light guide member 110 may be configured to be larger than the circular boundary of the display panel 600. Thus, the light guide member 110 may be configured to deviate from the display panel 600.

FIG. 5C illustrates a configuration of the light guide member 110 according to yet another example embodiment.

In the example embodiment of FIG. 5C, the light guide member 110 may be configured to cover the light emitting surface of the plurality of pixels PX which is adjacent to the plurality of edge pixels EP.

Thus, when some (apexes of the quadrangle and sides of the quadrangle) of the edges of the pixels PX border the edge pixels EP, the light guide member 110 may be configured to cover the pixels PX.

A part of the light guide member 110 may deviate from the area of the plurality of pixels PX which is adjacent to the edge pixels EP, and a part of the light guide member 110 may cover the edge pixels EP.

By way of summation and review, wearable smart devices and the like are being developed. Also, interest in display devices that are not a general rectangle. e.g., rounded or circular display devices, has been increasing. As representative examples, smart watches, smart glasses, and the like adopting such display panels are of interest.

The display device may adopt a display panel of a general quadrangle display device, while having rounded portions, a circular form factor, etc. Generally, the display panel of the quadrangle display device includes a plurality of pixels arranged in a matrix form, and pixels configured by one color of R, G, and B are arranged by an RGB stripe, a pentile, or an S-stripe method to display an image. However, in the rounded or circular display device, since an edge of the display panel has a curved shape, a plurality of quadrangular pixels is arranged in a stepped shape. In this case, the pixels corresponding to the edge of the display panel are not continuous, and as a result, an image display may be negatively affected. One way to mitigate such an effect is to cover the edge of the display panel by using other elements such as a black matrix. However, by such an approach, a display area of the display panel may be reduced, deteriorating performance, and a bezel size may be increased, deteriorating external appearance.

As described above, embodiments may provide a display device having rounded regions or a circular display device including a light guide member, which may also include rounded regions or a circular shape. Embodiments may provide such a display device having advantages of widely maintaining a display area and minimizing a bezel without deforming a shape of pixels of an existing display panel.

DESCRIPTION OF SYMBOLS

100: Optical element
110: Light guide member
200: Circular display device
300: Encapsulation substrate
400: Polarizer
500: Thin film encapsulation layer
600: Display panel
700: Bottom substrate Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope as set forth in the following claims.

What is claimed is:

1. A display device, comprising:
a circular display panel;
an encapsulation substrate on the circular display panel; and
an optical element interposed between the circular display panel and the encapsulation substrate, the optical element including a light guide member having a ring shape to correspond to a boundary of the circular display panel, the light guide member configuring a boundary of the optical element, wherein:
the circular display panel includes a plurality of pixels,
the plurality of pixels includes a plurality of edge pixels configuring a circular boundary of the circular display panel,
the light guide member has a ring shape to correspond to the plurality of edge pixels,
the plurality of edge pixels is arranged along a ring-shaped region configuring the circular boundary of the circular display panel, and
the plurality of edge pixels includes at least two edge pixels arranged in a stepped shape.

2. The display device as claimed in claim 1, further comprising a polarizer interposed between the optical element and the circular display panel.

3. The display device as claimed in claim 2, further comprising a thin film encapsulation layer interposed between the polarizer and the circular display panel.

4. The display device as claimed in claim 3, further comprising a bottom substrate below the circular display panel.

5. The display device as claimed in claim 1, wherein the light guide member covers a light emitting surface of the plurality of edge pixels.

6. The display device as claimed in claim 1, wherein the light guide member is larger than the circular boundary of the circular display panel.

7. The display device as claimed in claim 1, wherein the light guide member covers a light emitting surface of pixels adjacent to the plurality of edge pixels.

8. The display device as claimed in claim 1, wherein:

the encapsulation substrate includes a concave part etched to correspond to the shape of the light guide member, and at least a part of the light guide member is in the concave part.

9. The display device as claimed in claim 1, wherein, in the optical element, the light guide member surrounds a void.

10. The display device as claimed in claim 1, wherein, in the optical element, the light guide member surrounds a portion made of a light transmitting material.

11. The display device as claimed in claim 10, wherein the light transmitting material and the encapsulation substrate are made of the same material.

12. A display device, comprising:

an active display panel including a plurality of pixels arranged in a regular array, an outermost boundary of the array including at least one stepped area in which the pixels form a staircase arrangement in a plan view, all pixels in the at least one stepped area having a same shape and arrangement as other pixels in the regular array; and a visible light-transmitting solid member overlapping the stepped area in the plan view such that visible light emitted from pixels in the stepped area is visible through the solid member, the solid member defining an interior region.

13. The display device as claimed in claim 12, wherein the solid member contacts an upper surface of pixels in the stepped area.

14. The display device as claimed in claim 12, wherein the pixels of the active display panel are individually addressable and are disposed in rows and columns in the array, ends of rows and columns forming the stepped area.

15. The display device as claimed in claim 14, wherein:

the pixels generate light, visible light emitted from all pixels in the stepped area is visible through the solid member, and some of the pixels generating light that is visible through the solid member to a user of the display device and some of the pixels generating light that is visible through the interior region to the user of the display device.

16. The display device as claimed in claim 12, wherein the interior region is in a vacuum state or filled with a fluid.

17. The display device as claimed in claim 16, wherein the fluid is a gas.

* * * * *